US009101249B1

(12) United States Patent
Tudor

(10) Patent No.: US 9,101,249 B1
(45) Date of Patent: Aug. 11, 2015

(54) SPA COVER LIFT ASSIST DEVICE

(76) Inventor: Jess E. Tudor, Medford, OR (US)

( * ) Notice: Subject to any disclaimer, the term of this patent is extended or adjusted under 35 U.S.C. 154(b) by 55 days.

(21) Appl. No.: 13/065,655

(22) Filed: Mar. 24, 2011

(51) Int. Cl.

| | |
|---|---|
| ***B66F 3/00*** | (2006.01) |
| ***B66D 1/00*** | (2006.01) |
| ***E04H 4/00*** | (2006.01) |
| ***A47K 3/08*** | (2006.01) |

(52) U.S. Cl.
CPC ..... *A47K 3/08* (2013.01)

(58) Field of Classification Search
USPC ..... 254/120, 127, 130, 131, 93 R, 4 R; 4/498, 503, 557
See application file for complete search history.

(56) References Cited

U.S. PATENT DOCUMENTS

2007/0210290 A1* 9/2007 Koren ..... 254/264

* cited by examiner

*Primary Examiner* — Lee D Wilson
*Assistant Examiner* — Nirvana Deonauth

(57) ABSTRACT

A spa cover lift assist device that attaches to the edge of a foldable spa cover that covers a conventional spa that has a cabinet with sides and a top, the cover lift assist device having a bracket that attaches to a side of the cabinet with a spring loaded arm having a first pivot end that engages a pivot pin in the bracket and a distal end that has a tether connected at one end to the distal end of the arm and anchored at the other end to the edge of the spa cover such that on folding the spa cover and displacing the folded cover toward the side of the spa cabinet on which the bracket is attached, the spring loaded arm aids in removing the folded cover from the spa.

9 Claims, 1 Drawing Sheet

SPA COVER LIFT ASSIST DEVICE

BACKGROUND OF THE INVENTION

This invention relates to a device to assist in the removal and replacement of a spa cover, typically a folded cover having one or more hinges. The lift assist device relates generally to a spa cover accessory similar to the stabilizer straps of my U.S. Pat. No. 7,496,975, issued Mar. 3, 2009, entitled, Stabilizer Straps for Spa Cover Lift and incorporated herein by reference. As described in the patent, two spaced stabilizer straps are each connected at one end to a spa cabinet and are looped through squeeze buckle loops on the skirt of the vinyl covering of a spa cover to connect to the cover. As the cover is folded and moved to one side of the spa, usually with the assistance of a cover lift mechanism, the stabilizer straps engage the edge of the cover and aid in lowering the cover to the side of the spa relieving some of the strain on the lift mechanism.

It has been found that the simple stabilizer strap system can be greatly improved by including the use of a spring-loaded counter balance system using a single rigid pivot arm connected to a pivot bracket mounted at the center of the back of the spa cabinet and connected at its distal end to a strap that loops around a handle fixed to the edge of the cover segment adjacent the back of the spa where the folded cover is stored. The pivot arm engages a torsion spring anchored in the pivot bracket in a manner similar to one of the side arms in the cover lift mechanism described in my U.S. Pat. No. 6,158,063 issued Dec. 12, 2000, entitled Spa Cover Lifting Device, incorporated herein by reference. The pivot arm both guides the folded cover as it is lowered at the back side of the spa, and loads the torsion spring to assist in removing the folded cover from the top of the spa.

SUMMARY OF THE INVENTION

The spa cover lift assist device of this invention is a mechanical aid fastened to the back side of a contemporary spa cabinet of a portable spa to assist in returning a spa cover stored at the back of the spa when the spa is in use. The cover lift assist device includes a lift arm that pivots in a pivot bracket secured to the back of the spa cabinet by screws and connected to a handle added to the center of the back edge of the spa by a tether. The tether is formed by a strap that loops through the handle with strap ends being secured to the distal end of the lift arm. The cover lift assist device is spring loaded so that when the spa cover is removed from the top of the spa, a coiled torsion spring releases its potential energy to the lift arm and aids in removing the spa cover from the top of the spa. Typically, the spa cover is of a folded type that is lowered and raised in its folded condition. Preferably the cover lift assist device operates with a conventional spa cover lift mechanism disclosed in the referenced patents or with the preferred cover lift system disclosed in my U.S. Pat. No. 6,938,281, issued Sep. 6, 2005.

DETAILED DESCRIPTION OF THE PREFERRED EMBODIMENT

Figure 1:
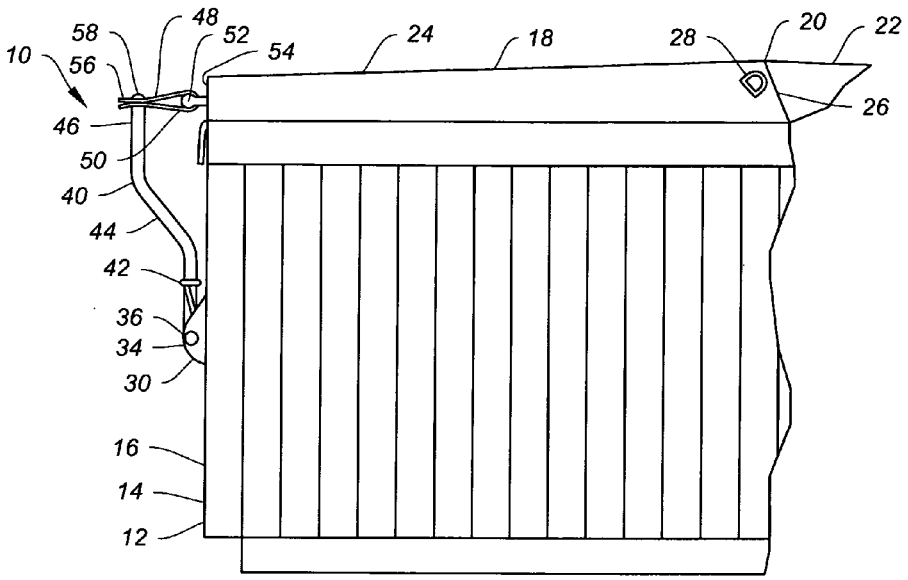
FIG. 1 is a side elevational view of the spa cover lift device mounted on the back side of a spa shown partially fragmented.

Referring to the drawings, the spa cover lift assist device, designated generally by the reference numeral 10, is shown with a conventional portable spa 12 mounted to the spa cabinet 14 on what is considered the back side 16 where the spa cover 18 is typically stored. The spa cover 18 is preferably of a folded type having a central hinge 20 that enables one segment 22 (show segmented) to be folded on top of the other segment 24 and stored in a folded condition at the back side 16 of the spa cabinet 14. The spa cover 18 in FIG. 1 has a preferred inclined juncture 26 for the two segments 22 and 24 at the central hinge 20 for thermal efficiency, and has a socket 28 for use by a preferred cover lift mechanism (not shown).

Figure 2:
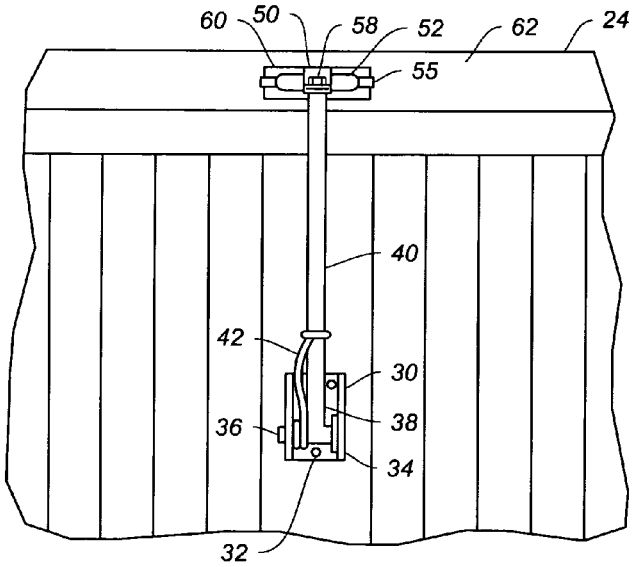
FIG. 2 is a back elevational view of the spa and the mounted spa cover lift device of FIG. 1.

The cover lift assist device 10 is mounted to the back side 16 of the spa cabinet 14 by a bracket 30 which is secured to the cabinet by screws 32. As shown in FIGS. 1 and 2, the bracket 30 has projecting sides 34 for support of a cross pin 36 at the pivotal end 38 of a bent pivot arm 40. The bracket 30 also provide for anchoring of a torsion spring 42 that coils around one side of the cross pin 36 and loops around the pivot arm 40 above the pivot to provide leverage. As the arm 40 pivots downwardly, the angled center section 44 transitions to a horizontal position to support the folded cover 18 at the back side of the spa 12. Preferably the system uses the stabilizer straps and cover lift mechanism as described in the referenced patents to assist in the support and uniform raising and lowering of the folded cover.

At the distal end 46 of the bent pivot arm 40 is anchored a tether 48 that is fabricated of a strong woven polypropylene strap 50 that loops around a handle 52 that is secured to the back edge 54 of the cover segment 24 nearest the back side 16 of the spa 12. The two ends 56 of the polypropylene strap 50 are secured to the distal end 46 of the bent pivot arm 40 by a bolt 58 that passes through holes (not visible) in the strap ends 56 and is threaded into the distal end 46 of the pivot arm 40. The handle 52 is solid EPDM with polypropylene end straps 55 that partially encircle and are secured to an anchor plate 60. The anchor plate in turn is secured to a short section of C-channel (not visible) that is embedded into the edge of the cover foam under the vinyl casing 62 of the cover segment 24 adjacent the back side of the spa 12.

The cover lift assist device 10 is primarily adjusted to assist in the removal of the folded cover 18. The strap 50 forming the tether 48 can be shortened or lengthened to increase or reduce the initial pull tending to remove the cover 18. Where a conventional cover lift mechanism is not used in conjunction with the lift assist device, a spring arrangement can be provided to assist in initial lift to replace the cover onto the top of the spa with a reduced pull for assisting removal. This dual action follows known principles in cover removal systems that recognize the effort required at the beginning and end of the removal process is greatest with the mid part being neutral and balanced.

It is understood that other modifications can be made to the preferred embodiment described without departing from the teachings of this invention.

The invention claimed is:

1. A spa cover lift assist device that is capable of being combined with a conventional spa and with a folding spa cover that covers the conventional spa, the conventional spa having a cabinet with sides and a top covered by the cover and the cover having a side edge, the lift assist device comprising:

a rigid lift arm having a first pivot end and a second distal pivoting end;

a bracket having a mount adapted and constructed to attach to one side of the cabinet of the conventional spa with fasteners, the bracket having a pivot assembly that pivotally connects to the first pivot end of the rigid lift arm, the pivot assembly having a spring bias element attached to the rigid lift arm to bias the lift arm to a vertical position to assist in displacing the folding spa cover to the top of the conventional spa when the cover is folded and stored at the side of the cabinet;

an anchor attachable to the spa cover at the side edge of the spa cover near the second distal pivoting end of the rigid lift arm, the anchor having a connector; and, a flexible tether connected to the second distal pivoting end of the rigid lift arm and connectable to the connector of the anchor when the spa cover lift device is combined with the conventional spa and folding spa cover, wherein the second distal pivoting end of the rigid lift arm is displaced a short distance from the anchor at the side edge of the spa cover and the lift arm is substantially vertical when the cover is covering the top of the spa, and is pivoted to a substantially horizontal position when the cover is folded and stored at the side of the cabinet and resting on the rigid lift arm and, wherein the rigid lift arm is a tube having a bend to displace the second distal pivoting end of the rigid lift arm from the anchor at the side edge of the folding spa cover when the rigid lift arm is substantially vertical.

2. The spa cover lift assist device of claim 1 wherein the connector of the anchor is a handle that the flexible tether engages to connect the folding spa cover to the second distal pivoting end of the rigid lift arm.

3. The spa cover lift assist device of claim 1 wherein the tether has means for adjusting the length of the tether.

4. The spa cover lift assist device of claim 1 wherein the pivot assembly has means for adjusting the bias of pivot of the rigid lift arm on adjustment of the length of the tether.

5. A spa cover lift assist device that is capable of being combined with a conventional spa and with a folding spa cover that covers the conventional spa, the conventional spa having a cabinet with sides and a top covered by the cover and the cover having a side edge, the lift assist device comprising:

a rigid lift arm having a first pivot end and a second distal pivoting end;

a bracket having a mount adapted and constructed to attach to one side of the cabinet of the conventional spa with fasteners, the bracket having a pivot assembly that pivotally connects to the first pivot end of the rigid lift arm, the pivot assembly having a spring bias element attached to the rigid lift arm to bias the lift arm to a vertical position to assist in displacing the folding spa cover to the top of the conventional spa when the cover is folded and stored at the side of the cabinet;

an anchor attachable to the spa cover at the side edge of the spa cover near the second distal pivoting end of the rigid lift arm, the anchor having a connector; and, a flexible tether connected to the second distal pivoting end of the rigid lift arm and connectable to the connector of the anchor when the spa cover lift device is combined with the conventional spa and folding spa cover, wherein the second distal pivoting end of the rigid lift arm is displaced a short distance from the anchor at the side edge of the spa cover and the lift arm is substantially vertical when the cover is covering the top of the spa, and is pivoted to a substantially horizontal position when the cover is folded and stored at the side of the cabinet and resting on the rigid lift arm and, wherein the bracket has projecting sides and the first pivot end of the rigid lift arm has a cross pin that engages the projecting sides of the bracket.

6. The spa cover lift assist device of claim 5 wherein the spring bias element of the pivot assembly is a torsion spring anchored to the bracket and wrapped in part around the cross pin and the first pivot end of the lift arm.

7. The spa cover lift assist device of claim 6 wherein the anchor has a plate with means for fastening the plate to the spa cover.

8. The spa cover lift assist device of claim 3 wherein the connector of the anchor is a handle and the tether comprises a strap that loops around the handle and has ends with holes wherein the means for adjusting the length of the strap includes a series of holes.

9. The spa cover lift assist device of claim 8 wherein the second distal pivoting end of the rigid lift arm includes a bolt that engages holes in the ends of the strap to secure the strap to the rigid lift arm.

* * * * *